United States Patent [19]

Vinciguerra

[11] 4,042,271

[45] Aug. 16, 1977

[54] DEVICE FOR AUTOMATICALLY GRASPING PIECES OF FABRIC

[75] Inventor: Costantino Vinciguerra, Florence, Italy

[73] Assignee: Nuovo Pignone, S.p.A., Florence, Italy

[21] Appl. No.: 668,806

[22] Filed: Mar. 19, 1976

[30] Foreign Application Priority Data

Mar. 20, 1975 Italy ..... 21454/75

[51] Int. Cl.[2] ..... B65H 3/22

[52] U.S. Cl. ..... 294/61; 294/110 R; 271/18.3

[58] Field of Search ..... 271/18.3, 19, 21–23, 271/141; 294/61, 110 R; 221/214, 215; 112/121.11, 121.29

[56] References Cited

U.S. PATENT DOCUMENTS

| | | | |
|---|---|---|---|
| 3,402,833 | 9/1968 | Pershing | 294/61 X |
| 3,813,094 | 5/1974 | Walton et al. | 271/19 |

*Primary Examiner*—Robert W. Saifer

*Attorney, Agent, or Firm*—Ralph M. Watson

[57] ABSTRACT

A device for automatically grasping fabric pieces, more particularly a single fabric piece at a time, comprising a set of tapered and bent points parallely mounted near to the lower vertex of a triangle shaped oscillating member; the latter is pivotably mounted to the head of a movable body, and the said member oscillates between two end positions, a resilient inverted U shaped element being provided to maintain said member in either end position, the resilient element being supported also by the movable body, whereby a single piece of fabrics is grasped at each oscillation of the said member by the points penetrating it.

5 Claims, 5 Drawing Figures

DEVICE FOR AUTOMATICALLY GRASPING PIECES OF FABRIC

The present invention relates to a device for automatically grasping pieces of fabric having any thickness, particularly suitable for use in a process for handling pieces of fabric during automatic proceedings such as that described in the Italian patent specification 979,264.

As is known, in such a process the piece grasping device is required to be suitable for grasping securely a single piece of fabric at a time even when the pieces are stacked, and therefore is required to be indifferent to the thickness of each piece as well as to have such a configuration and size as not to encumber and interfere with the moving work members.

Devices for grasping pieces of fabric are already known from the prior art, but these known devices all present the drawbacks involved in not ensuring the grasping of a single piece at a time, above all in the presence of pieces having a small thickness, for example of one or two tenths of a millimeter. This is due to the fact that, owing to the way in which, in the known devices, the grasping needles are made, mounted and operated, said needles are obliged to perform oscillations having a relatively large radius so that they may pass right through the pieces of small thickness and hence grasp the underlying pieces also.

The aim of the present invention is to obviate the aforesaid drawback and thus to provide a device having all the aforesaid features.

This is achieved, according to one embodiment of the present invention, by making use of grasping elements consisting of a set of tapered and greatly curved points mounted in parallel near the lower vertex of an oscillating member having substantially the shape of a triangle provided with side grooves at the ends of its upper baseside, which member is pivotally mounted at the said vertex in the middle zone of a slit of the head of a movable body so that it may oscillate between two end positions where it is maintained by a resilient element shaped substantially in the form of an inverted U, which constantly bears on the said oscillating member and is supported by the said head of the movable body.

With such a realization, in fact, it is now constructionally possible to cause the distance between said points and their center of oscillation, i.e. the pivot pin of the said oscillating member, to have the same order of magnitude as the smallest thickness of the pieces of fabric to be grasped, i.e. one or two tenths of a millimeter.

In such manner it is ensured that the points, through grasping the piece of minimum thickness, do not traverse it so as to affect the underlying pieces.

On the other hand the considerable curvature of the points causes the free ends of said points to come out again from the grasped piece, so that the latter is firmly hooked to said points without the possibility of unhooking.

This very sure and effective grasping of the piece allows, furthermore, a tear-off raising of the piece, which is necessary to detach the piece from the other underlying pieces given that they are generally stuck together as a result of the hairiness of their adjacent faces.

According to another embodiment of the invention the said movable body is axially slidable, without rotating, against the action of a helical spring within a box-shaped base body supporting along its axis a vertical, forked resilient blade which, because of a relative motion of translation between the said two bodies, cooperates alternately with the one or the other of the said two side grooves of the oscillating member so as to bring the latter into one or the other of its two end positions at which the points are retracted or pushed out into their piece-grasping position.

In this way the device acts as a self-contained device, since it requires for its working a simple pressure exerted on the upper base of the said box-shaped base body.

In fact, the head of the movable body being laid on the piece to be grasped, a pressure exerted by hand or in mechanically on the upper base of the said base body, towards the piece, by overcoming the reaction of the said helical spring, obliges the said base body to move axially along the movable body and to insert the end of its resilient blade into the facing side groove of the oscillating member which is in one of its two end positions; the further translation of the base body then obliges the oscillating member to rotate towards its other end position, i.e. corresponding to the position where the points jut out in their position of grasping the piece, where it is maintained by the said inverted U-shaped resilient element also when the action of the pressure is stopped and the said bodies are brought back to their rest position by the said helical spring.

The application now of a new pressure causes the said resilient blade to enter the other side groove of the oscillating member, which now faces it, so that said oscillating member is obliged to rotate towards its first end position, i.e. corresponding to the position where the points are retracted.

In the final analysis, the application of subsequent pressures moves the oscillating member alternately from the one to the other of its two end positions.

From what has been said, and given the fact that the device can be realized in very compact and contained size, it will be easily understood that such a device is particularly suited to be used for handling pieces of fabric in automatic processes.

In fact, a simple pressure imparted in any way whatever makes it possible to firmly grasp a piece of fabric having any thickness and to carry it to any desired place where, in order to release it, there is only the need to apply a further pressure, after which the device is automatically ready to grasp a new piece of fabric.

Furthermore, in order to make it easier for the points to grasp a piece of fabric, according to another embodiment of the invention, on the outer face of the head of the movable body there is placed a presser plate presenting as many slits as grasping points are used, said slits being orientated in the direction of rotation of the said points.

Said presser plate serves to flatten the fabric in the zone where the points have to be inserted and, in order to increase said flattening by means of a pressure, according to a further embodiment of the invention the vertical, forked resilient blade axially supported by the said base body is made of such a length that it does not bear directly on the oscillating member, when the device is in its rest position, but a certain interspace is left between the free end of the said blade and the said oscillating member.

In this way, in fact, when an actuating pressure is applied, the oscillating member is operated only after a certain time lag during which the said actuating pressure acts as a fabric flattening pressure, said time lag being the time taken by the resilient blade to come into contact with the oscillating member.

The invention will be now illustrated in the accompanying drawings which are merely exemplary and non-limiting embodiments, in that the adoption of constructional techniques or equivalent members different from those suggested herein lies within the scope of the present invention.

Figure 1:
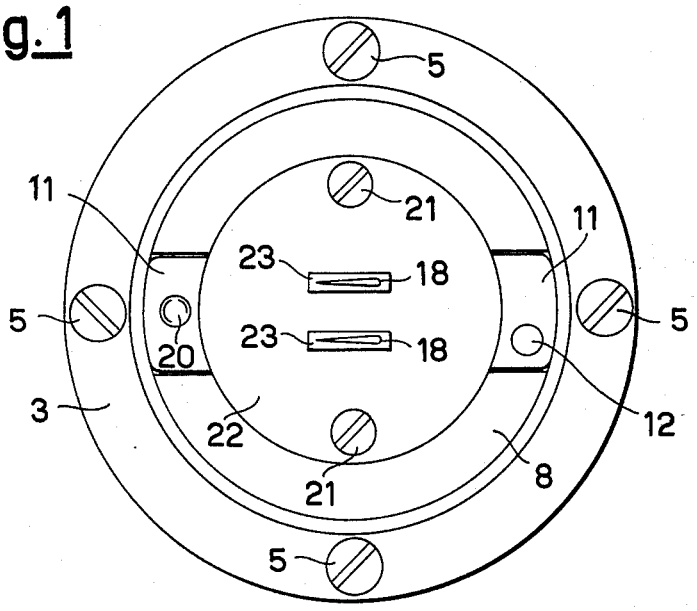
FIG. 1 shows a bottom view of the device for automatically grasping pieces of fabric according to the invention.

Referring now to the FIGURES, reference numerals 1 and 2 indicate two superimposed pieces of fabric respectively, the first of which has to be grasped by the grasping device of the invention.

Said device comprises a base body having a box-shape and, in particular, a cylindrical cross-section, which body consists of side walls 3 and of a closing rear plate 4 fixed to said walls by means of screws 5.

Into the base body there is inserted a hollow, movable body 6 having, in particular, a cylindrical cross-section.

Said movable body 6 can axially slide in opposition to the action of a helical spring 7 supported between the said closing plate 4 and a front, inner edge 8 of the same movable body 6 which, however, cannot rotate since it presents in its rear part vertical slots 9 entering vertical guides 10 protruding from walls 3 of the base body.

The movable body 6, which is prevented from coming out of the base body by suitable stop means on the walls of said bodies, is then closed in its front part by a head 11 kept centered in position by a dowel 12.

Said head 11 presents a slit 13 wherein there is pivotally mounted, at the axis of the movable body and by means of a pivot pin 14, an oscillating member 15 having substantially the shape of a triangle provided with side grooves 16 and 17 at the ends of the upper baseside and supporting near its lower vertex a set of tapered and curved points 18.

Figure 2:
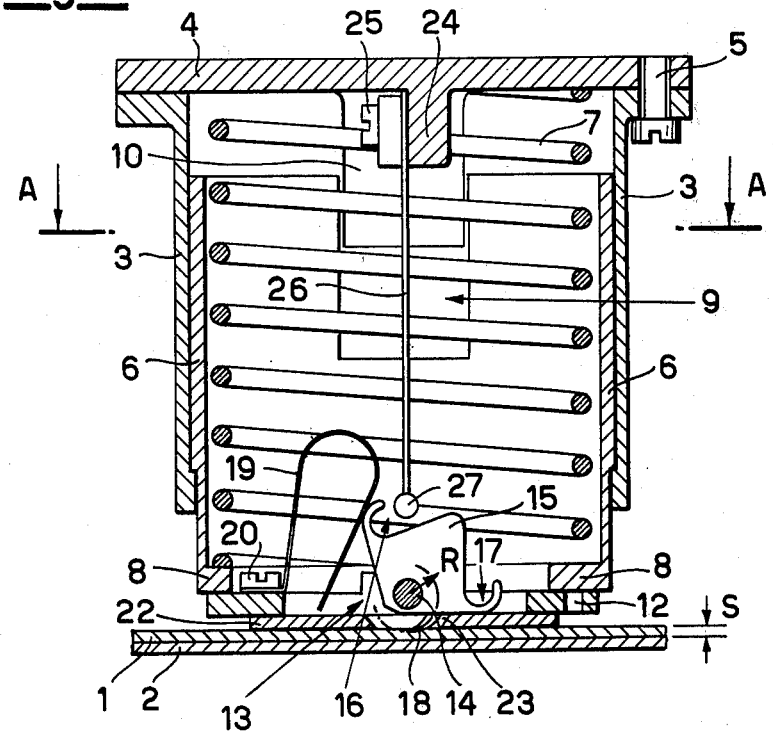
FIG. 2 shows a sectioned side view of the device of FIG. 1, laid on a set of two superimposed pieces of fabric.
Figure 3:
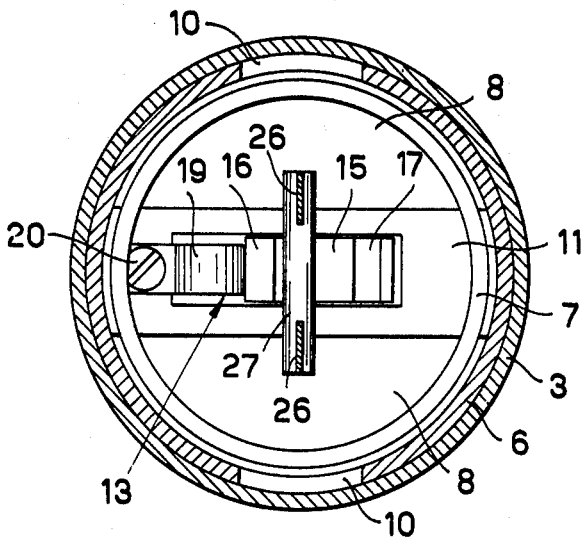
FIG. 3 shows a sectioned front view of the device made according to line A—A in FIG. 2.

Given that also the said pivot pin 14 is mounted near the said lower vertex it is clear that now there is the physical possiblity of causing the radius R (see FIG. 2) of the rotation of the points 18 to have the same order of magnitude as the smallest thickness $s$ of the pieces of fabric.

Figure 4:
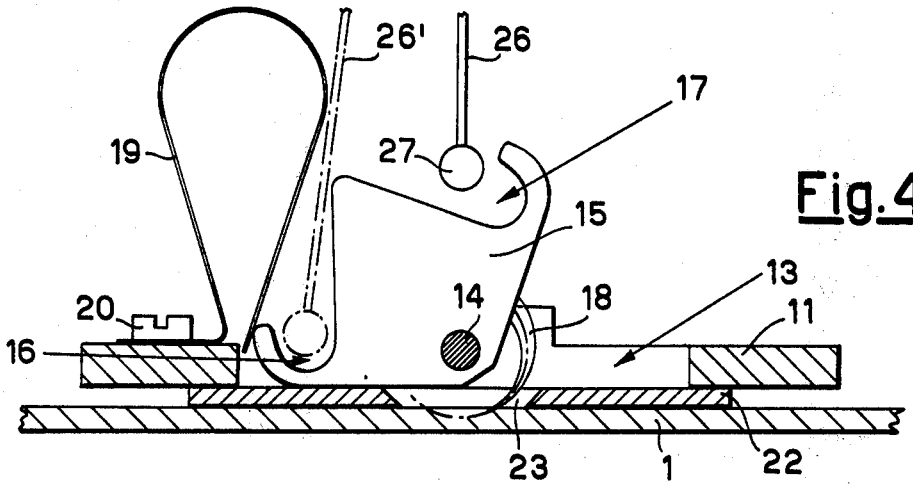
FIG. 4 shows on enlarged scale a sectioned side view of the front end part of the device, wherein the oscillating member is in its end position at which the points are retracted.
Figure 5:
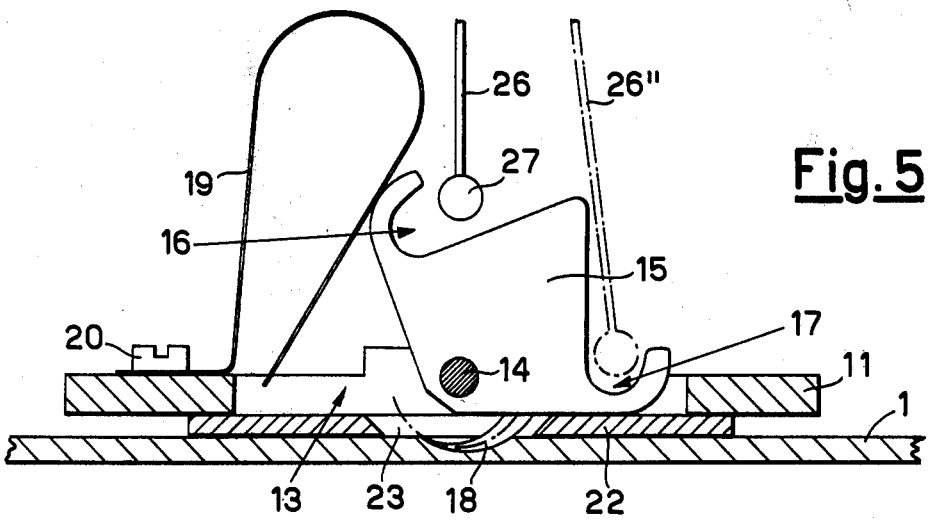
FIG. 5 shows a view similar to the one of FIG. 4, wherein, however, the oscillating member is in its other end position at which the points jut out in their position of grasping of the piece.

A resilient element 19 shaped substantially in the form of an inverted U, is fixed by means of a screw 20 to the head 11 and is constantly kept pressed on the oscillating member 15 so that the latter can be positioned only in two end positions, shown in FIGS. 4 and 5 respectively, at which the points 18 are all retracted (see FIG. 4) or jut out in their position of grasping of the piece (see FIG. 5).

On the outer side of the edge 8 of the movable body there is then screwed by means of screws 21 a presser plate 22 presenting as many slits 23 as points 18 are used, said slits being orientated in the direction of rotation of the said points.

Said presser plate 22 serves also to hold in position the said head 11 of the movable body 6.

The closing plate 4 of the base body presents, finally, at the middle zone of its inner face a projecting block 24 to which, by means of screws 25, are fixed the ends of a vertically disposed forked, resilient blade 26, which terminates at its other end in a horizontal, actuating cylinder 27.

The length of said resilient blade 26 is chosen in such a way that its actuating cylinder 27 does not touch the oscillating member 15 when the device is in its rest position.

The mode of operation has been described: if it is now assumed that the device is in its rest position as shown in FIG. 4, wherein the oscillating member 15 is in its end position at which the points are retracted and the forked resilient blade 26 faces the groove 17, then when a compression pressure is applied in any way to the plate 4 of the base body, owing to the relative motion of translation between the base body and the movable body, the resilient blade 26 is brought at first into contact with the groove 17 and then, by bending itself as shown by reference numeral 26″ (see FIG. 5), it obliges the oscillating member 15 to rotate and so to insert the points 18 into the piece of fabric.

When the compression action of the pressure ceases and the base body and the movable body are returned to their rest position in consequence of the action of the helical spring 7, the device is in the condition shown in FIG. 5, wherein the forked resilient blade 26 faces now the groove 16.

Owing to a further compression of the plate 4, the blade 26, by bending itself as shown by reference numeral 26′ (see FIG. 4), obliges the oscillating member to rotate in an opposite direction to its first direction of rotation and consequently to bring the points 18 out of the piece.

In the new rest position the device is thus in the initial condition shown in FIG. 4 and the cycle is repeated when a further compression pressure is applied.

What is claimed is:

1. A device for automatically grasping pieces of fabric comprising:

a movable body including a head with a slit therein, an oscillating member having substantially the shape of a triangle with at least one point mounted near the lower vertex of said oscillating member, side grooves at the ends of the upper base side of said member, said member being pivotally mounted on said lower vertex to said head in the middle zone of said slit, a resilient element shaped substantially in the form of an inverted U supported by said head of said movable body, which constantly bears on said oscillating member, said point depending from said oscillating member and extending through said slit when said member is oscillated in a predetermined manner for automatically grasping a piece of fabric.

2. A device according to claim 1, wherein said at least one point comprises a set of tapered and curved points, and further including:

a box shaped base body having a helical spring therewithin, and in which said movable body is axially slidable, without rotation, against the action of said spring, a resilient blade supported by and within said box shaped body along the vertical axis thereof which, upon relative motion of translation between said two bodies, cooperates alternatively with said side grooves of said oscillating member so as to oscillate said member between two end positions, wherein in one end position said depending point is retracted within said slit, and wherein said other end position said depending points are extended through said slit for automatically grasping a piece of fabric.

3. A device according to claim 2, wherein said resilient blade axially supported by the said base body is of such a length that the free end of the said blade is spaced from said oscillating member when the device is in its rest position.

4. A device according to one claim 2, wherein said base-body and said movable body each have a cylindrical shape.

5. A device according to claim 2, wherein a presser plate is mounted on the outer face of said head of said movable body, and wherein said presser plate has a slit therethrough for each fabric grasping point depending from said oscillating member.

* * * * *